US012439983B2

(12) United States Patent
Meroe

(10) Patent No.: US 12,439,983 B2
(45) Date of Patent: Oct. 14, 2025

(54) CRAWLING GLOVES

(71) Applicant: Vul-khane Meroe, Covington, WA (US)

(72) Inventor: Vul-khane Meroe, Covington, WA (US)

( * ) Notice: Subject to any disclaimer, the term of this patent is extended or adjusted under 35 U.S.C. 154(b) by 0 days.

(21) Appl. No.: 18/079,758

(22) Filed: Dec. 12, 2022

(65) Prior Publication Data

US 2023/0113920 A1 Apr. 13, 2023

Related U.S. Application Data

(63) Continuation of application No. 16/414,729, filed on May 16, 2019, now Pat. No. 11,523,646.

(51) Int. Cl.

| | |
|---|---|
| ***A41D 11/00*** | (2006.01) |
| ***A41D 19/00*** | (2006.01) |
| ***A41D 19/015*** | (2006.01) |

(52) U.S. Cl.

CPC ..... *A41D 19/01594* (2013.01); *A41D 11/00* (2013.01); *A41D 19/0017* (2013.01); *A41D 19/01558* (2013.01); *A41D 2300/32* (2013.01); *A41D 2400/80* (2013.01)

(58) Field of Classification Search

CPC ..... A41D 19/01594; A41D 11/00; A41D 19/0017; A41D 19/01558; A41D 2300/32; A41D 2400/80

See application file for complete search history.

(56) References Cited

U.S. PATENT DOCUMENTS

| | | | | | |
|---|---|---|---|---|---|
| 2,498,122 | A * | 2/1950 | Haniuk | A61F 5/50 | 128/880 |
| 3,581,312 | A * | 6/1971 | Nickels | A63B 71/148 | 473/450 |
| 3,606,614 | A * | 9/1971 | Dimitroff | A63B 71/148 | 473/59 |
| 3,707,730 | A * | 1/1973 | Slider | A63B 71/148 | 2/161.1 |
| 3,736,926 | A * | 6/1973 | Irby | A61F 5/37 | 15/227 |
| 3,835,472 | A * | 9/1974 | Duggins | A63B 71/148 | 473/59 |
| 4,173,218 | A * | 11/1979 | Cronin | A61F 5/05866 | 128/DIG. 20 |
| 4,706,658 | A * | 11/1987 | Cronin | A61F 5/10 | 128/DIG. 20 |
| 4,709,694 | A * | 12/1987 | O'Connell | A61F 13/104 | 2/167 |
| 4,738,447 | A * | 4/1988 | Brown | A63B 71/148 | 473/450 |

(Continued)

*Primary Examiner* — Richale L Quinn

(74) *Attorney, Agent, or Firm* — FisherBroyles, LLP; Jeremy P. Sanders

(57) ABSTRACT

A glove includes a fingerless glove body having a stiffener between the thumb and pointer finger to prevent a person from picking up objects between the thumb and pointer finger and putting them into her mouth. A brace is also provided to prevent the wearer from touching the palm of the glove with their fingers to further prevent a person from pickup up objects by making a fist and putting the objects into her mouth. The glove further provides abrasion resistance and slip resistance, such as for a crawling baby.

20 Claims, 6 Drawing Sheets

(56) References Cited

U.S. PATENT DOCUMENTS 4,894,866 A * 1/1990 Walker ..... A41D 19/01547 2/910
4,953,568 A * 9/1990 Theisler ..... A61F 13/105 128/880
5,063,613 A * 11/1991 Brown ..... A61F 5/05866 128/880
5,279,545 A * 1/1994 Reese, Sr. ..... A61F 5/013 602/21
5,590,421 A * 1/1997 Craner ..... A41D 19/0034 128/880
5,634,214 A * 6/1997 St. Ville ..... A63B 71/146 2/161.1
5,771,901 A * 6/1998 O'Brien ..... A61F 5/0118 128/878
5,787,896 A * 8/1998 Sackett ..... A41D 19/01588 128/880
5,810,753 A * 9/1998 Eberbach ..... A61F 5/0118 602/20
5,819,313 A * 10/1998 McCrane ..... A63B 71/14 473/62
5,846,168 A * 12/1998 Murray ..... A63B 21/4021 2/161.4
6,199,211 B1 * 3/2001 Franzolino ..... A41D 13/082 128/878
6,200,286 B1 * 3/2001 Zamani ..... A61F 5/0118 602/20
6,223,353 B1 * 5/2001 Lardieri, Jr. ..... A41D 13/082 2/160
6,427,246 B1 * 8/2002 Doi ..... A41D 19/01588 2/161.1
6,496,984 B1 * 12/2002 Chow ..... A61F 5/0118 2/16
6,783,507 B1 * 8/2004 Fisher ..... A61F 5/0118 602/5
6,834,397 B1 * 12/2004 Murphy ..... A63B 69/0066 2/161.1
7,140,046 B2 * 11/2006 Ono ..... A41D 19/01523 2/160
7,179,180 B1 * 2/2007 Frost ..... A63B 69/0002 473/206
7,210,172 B2 * 5/2007 Adams, Jr. ..... A63B 21/4025 2/21
7,377,566 B2 * 5/2008 Gazaui ..... B65G 7/12 294/142
7,469,426 B2 * 12/2008 Roeckl ..... A41D 19/01523 2/161.6
7,582,030 B2 * 9/2009 LaPergola ..... A63B 69/0071 473/464
7,758,526 B2 * 7/2010 DeGould ..... A61B 5/14552 128/880
8,209,771 B1 * 7/2012 Sykes ..... A41D 13/082 2/21
8,312,563 B1 * 11/2012 Burns ..... A41D 19/01588 2/161.1
8,677,514 B1 * 3/2014 Jones ..... A41D 19/0024 2/161.1
8,763,162 B2 * 7/2014 LoMedico ..... A41D 13/082 2/20
9,504,282 B1 * 11/2016 Frederick ..... A41D 19/01582
9,526,280 B2 * 12/2016 Robinson ..... A63B 71/14
9,549,836 B2 * 1/2017 Anglada ..... A61F 5/0118
9,888,733 B2 * 2/2018 Hull ..... A41D 19/01529
10,245,171 B2 * 4/2019 Stefansson ..... A61F 5/05866
10,645,984 B2 * 5/2020 Hull ..... A41D 19/01529
10,716,695 B2 * 7/2020 Grim ..... A61F 5/0118
10,729,192 B2 * 8/2020 Quirk ..... A41D 19/0013
10,750,803 B2 * 8/2020 Hull ..... A41D 13/082
10,842,661 B1 * 11/2020 Gaylord ..... A61F 5/05875
11,523,646 B2 * 12/2022 Meroe ..... A41D 19/01588
11,825,887 B2 * 11/2023 Hull ..... A41D 13/082
2003/0070204 A1 * 4/2003 Summers ..... A41B 13/00 2/16
2003/0191421 A1 * 10/2003 Weaver, II ..... A61F 5/0118 602/22
2005/0145255 A1 * 7/2005 Mengato ..... A61F 5/05866 128/878
2006/0149180 A1 * 7/2006 Phelen ..... A63B 21/4025 602/5
2006/0276735 A1 * 12/2006 Phelen ..... A63B 21/4025 602/21
2011/0099687 A1 * 5/2011 Skrocki ..... A41D 19/01523 2/161.1
2012/0178554 A1 * 7/2012 Heflin, Sr. ..... A63B 69/0071 473/450
2013/0036523 A1 * 2/2013 Webster ..... A41D 19/01523 2/19
2013/0041301 A1 * 2/2013 Grim ..... A61F 5/0118 602/21
2014/0330189 A1 * 11/2014 Kilbey ..... A61F 5/0118 602/21
2015/0113703 A1 * 4/2015 Crear ..... A41D 19/0024 2/160
2016/0148603 A1 * 5/2016 Anderson ..... A41D 19/00 84/328
2017/0209299 A1 * 7/2017 Szopa ..... A41D 19/0048
2017/0215497 A1 * 8/2017 Frederick ..... A61F 5/0118
2017/0245564 A1 * 8/2017 Yoon ..... A41D 19/0062
2017/0258689 A1 * 9/2017 Drysdale ..... A41D 19/002
2017/0319935 A1 * 11/2017 Griffee ..... A63B 71/148
2018/0168252 A1 * 6/2018 Hull ..... A41D 19/0006
2019/0281907 A1 * 9/2019 Frederick ..... A61F 5/10
2020/0359721 A1 * 11/2020 Meroe ..... A41D 19/01558
2021/0212854 A1 * 7/2021 Gaylord ..... A61F 5/0118
2023/0113920 A1 * 4/2023 Meroe ..... A41D 19/0017 2/160

* cited by examiner

CRAWLING GLOVES

This application is a continuation of, and claims the benefit of, U.S. patent application Ser. No. 16/414,729, filed May 16, 2019, the disclosure of which is hereby incorporated, in its entirety, by this reference.

BACKGROUND

The field of the present disclosure is related to gloves for young children and babies. In many cases, as babies begin to develop motor skills and desire sensory experiences, many babies learn to put objects in their mouths.

A baby may enter this oral phase, where they explore the world around them with their mouths, anywhere from about two to four months of age, which typically lasts until a baby is between twelve and eighteen months old. During this period of time, a caregiver must be diligent about keeping things out of reach of the baby that may be harmful. For instance, small objects may present a choking hazard, other items may be dirty or germ-ridden, and still other items may be toxic to a baby.

As a baby continues to grow, between about six and ten months of age, many babies begin to become mobile, such as by crawling, scooting, or rolling. As a baby becomes mobile, there are increased opportunities to encounter objects that the baby can put in her mouth.

Despite a caregiver's best efforts to keep the area around a mobile baby safe, a baby may still encounter objects that may be harmful. Consequently, there is a need to keep babies safe from objects that may be harmful, especially as they become mobile.

SUMMARY

Babies and young children learn about their world by putting things in their mouths and sometimes swallowing small objects. Many of these objects may be relatively harmless, but some of them can have severe consequences. As a baby gains mobility, such as by crawling, rolling, or scooting, the opportunity for a baby to swallow things such as coins, beads, marbles, batteries, magnets, tablets, buttons and even broken glass increases dramatically. The same may be said about older children, teenagers, and adults with limited mental capacity, for example, and these people should be protected as well.

A glove is provided in order to prevent, or at least inhibit, a person from picking up objects and putting them into her mouth. This is accomplished by a glove that prevents a wearer of the glove from bringing their thumb and pointer finger together. The glove still allows the person to be mobile and move their fingers, just not in a way to grasp small objects, thereby reducing the opportunities for a person to place harmful objects into her mouth.

According to some embodiments, a fingerless glove includes a palm portion, a back portion, a finger hole to allow at least a second digit to extend therethrough, a thumb hole to allow a thumb to extend therethrough, a stiffening member positioned between the finger hole and the thumb hole to inhibit a wearer from brining fingertips of the second digit and thumb into close proximity to one another, and a brace member attached to the palm portion adjacent to the finger hole to inhibit deformation of the palm portion to inhibit a wearer from moving a fingertip of the second digit in close proximity to the palm portion. As used herein, the term "close proximity" is a broad term and is used to describe the separation distance of a baby's fingers in order to pick up objects. In many cases, this may be on the order of 0.5", or 0.75", or 1" or a similar distance.

In some instances, the stiffening member is attached to the fingerless glove and extends between the finger hole and the thumb hole from the palm portion to the back portion. The stiffening member may be permanently or removably attached to the glove. In some cases, the stiffening member is removably attached by a hook and loop fastener system.

A wear pad may be provided on the palm portion of the glove that not only provides abrasion resistance to the glove, but also protects a baby wearing the glove from rough surfaces, such as concrete, splintered wood, and other surfaces. In addition, the palm portion of the glove may further include a non-skid surface. In some cases, the wear pad and the non-skid surface are the same element. In some cases, the non-skid surface is provided by surface deformations on the palm portion.

The finger hole may be sized to allow the second digit, a third digit, a fourth digit, and a fifth digit to extend therethrough. In other words, the finger hole may allow four fingers of a wearer to extend therethrough.

According to some embodiments, a baby glove has a body having a palm side and a back side and an open end for receiving a hand. The body defining a thumb hole to allow a thumb to extend therethrough and a finger hole to allow one or more fingers to extend therethrough. A stiffening member is located between the thumb hole and the finger hole to inhibit a wearer from bringing a thumb fingertip into close proximity to a second digit fingertip. This also prevents a wearer from touching the thumb fingertip to the fingertip of the pointer finger. By inhibiting the fingers from coming into close proximity prevents a baby from picking up small objects between these two fingers, as is common with crawling babies.

The baby glove may additionally have a brace member located on the palm side adjacent the finger hole. The brace member may add stiffness to this portion of the glove to inhibit a wearer from bringing the second digit fingertip into close proximity with the palm side, and thus prevents a baby from grasping objects between their fingers and palm. The brace member may inhibit the wearer from brining a third digit fingertip, a fourth digit fingertip, and a fifth digit fingertip into close proximity with the palm side. In some instances, the brace member inhibits flexion of one or more metacarpophalangeal joints of the wearer. The metacarpophalangeal joint is more commonly known as the knuckle, and where the hand is inhibited from bending at the knuckle joint, the baby is inhibited from grasping objects by bending her fingers toward her palm. Similarly, the stiffening member may inhibit abduction and opposition of a carpometacarpal joint of the baby's thumb, thereby preventing her from picking up objects by bending her thumb either to her other fingers or to her palm.

In some instances, the stiffening member fixes the relative position between the thumb hole and the finger hole. That is, between the finger hole and thumb hole, the glove is relatively inflexible. The finger hole may be sized to allow four fingers of a wearer to extend therethrough, or multiple finger holes may be provided to each allow a finger to protrude therethrough.

In some cases, the stiffening member is removably attached to the baby glove, while in other it may be affixed, such as by being sewn into the glove, such as during manufacturing. A fastening member may be provided for securing the baby glove to the wrist of a wearer. The fastening member may be a hook and loop fastener.

According to some embodiments, a baby glove is formed as a fingerless glove body and a stiffening member that inhibits a wearer of the baby glove from touching a thumb to a pointer finger. This inhibits a baby wearing the gloves from picking up potentially dangerous items and putting them into her mouth. Optionally, a brace member may be included that inhibits the wearer of the baby glove from touching the pointer finger, middle finger, ring finger, or little finger to a palm of the fingerless glove body. This further inhibits a baby wearing the gloves from picking up objects between their fingers and palm.

BRIEF DESCRIPTION OF THE DRAWINGS

A better understanding of the features, advantages and principles of the present disclosure will be obtained by reference to the following detailed description that sets forth illustrative embodiments, and the accompanying drawings of which.

DETAILED DESCRIPTION

The following detailed description provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

Figure 1:
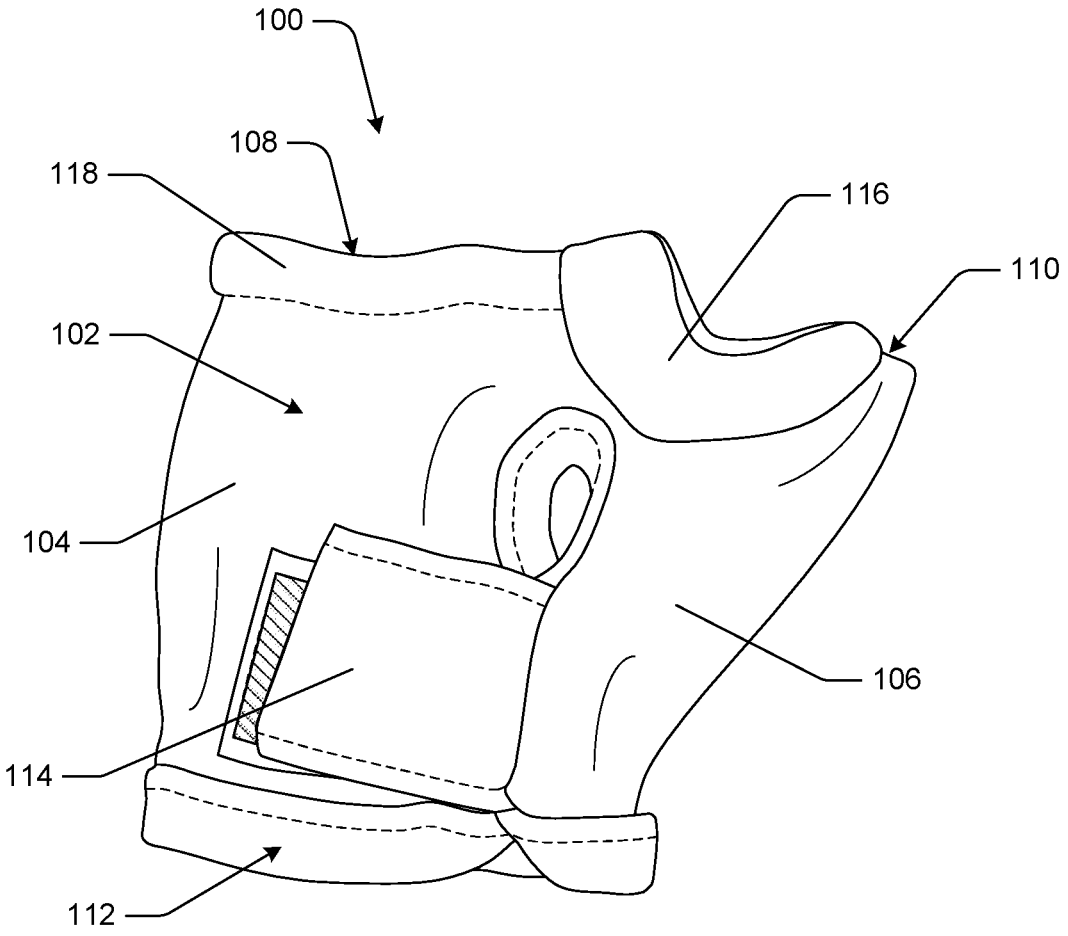
FIG. 1 shows a fingerless glove incorporating a stiffening member, in accordance with some embodiments.

With reference to FIG. 1, an example of a crawling glove 100 is illustrated. The crawling glove, or just "glove," which may be used interchangeably with "crawling glove" is an item of apparel sized to fit the hand of a baby who is in the crawling phase of life. That is, a baby from about 6 months of age to about 18 months of age, which is the typical age that most babies crawl as their primary mode of locomotion. Of course, the sizing of the glove may encompass a wider range of child, but in some instances, it is sized to fit the hand of a baby that is about 6 months to about 18 months old.

As illustrated, the glove may be fingerless, thus allowing the fingers of the wearer to extend beyond the glove and be available for sensory exploration and learning. The glove 100 generally includes a back portion 102, such as for covering the back of the hand, which may be formed by a lateral portion 104 and a medial portion 106, a finger hole 108 that allows fingers of the wearer to protrude therethrough, and a thumb hole 110 that allows the thumb of a wearer to protrude therefrom.

The glove 100 may also include a wrist portion 112 that is sized to fit around the wrist of a user. In some embodiments, the wrist portion 112 may include an elastomeric material that keeps the glove snug against the wrist of a user. In some embodiments, a closure 114 may be provided to secure the medial portion 106 and the lateral portion 104 together to secure the glove 100 onto the hand of a wearer.

As illustrated, the closure 114 may be formed by cooperating surfaces of the lateral portion 104 and the medial portion 106. In some instances, a hook and loop fastening system may be utilized, such as by providing a hook surface on one of the lateral portion 104 or the medial portion 106 and a loop surface on the other one of the lateral portion 104 or the medial portion 106. In this way, the lateral portion 104 may be drawn tight around the hand of a user and secured to the medial portion 106. Of course, other fastening mechanisms can be used, such as, for example, one or more snaps, a zipper, or elasticity integral to the glove 100.

Padding may be provided within the back portion 102, such as to make the glove 100 comfortable to wear during extended periods. Alternatively, or in addition, padding may be provided at a finger hole rim 118 that is adjacent the finger hole 108 to make the glove 100 comfortable for the fingers of a wearer.

For purposes of this disclosure, a hand of a wearer has five digits, the thumb (or the first digit), an index finger (or second digit), a middle finger (or third digit), a ring finger (or fourth digit), and a little finger (or fifth digit). When referring to the four fingers of a user, this describes the second, third, fourth, and fifth digits, exclusive of the thumb. The four fingers of a user will typically each have a plurality of interphalangeal digital creases. Specifically, each of the four fingers will have a proximal interphalangeal digital crease, a middle interphalangeal digital crease, and a distal interphalangeal digital crease.

In some embodiments, the glove 100 allows the four fingers of a wearer to extend beyond the finger hole 108 to expose the distal interphalangeal digital crease and the middle interphalangeal digital crease. In some embodiments, the proximal interphalangeal digital crease does not extend through the finger hole 108, as will be described hereinafter.

A stiffening member 116 may be located in the glove 100 between the thumb and the second digit of a wearer and may be sized and located to inhibit movement of the thumb and/or the second digit. More specifically, in some embodiments, the stiffening member 116 prevents the thumb and second digit from coming into contact with each other. For example, where a wearer of the glove 100 tries to pick up a small object, the stiffening member 116 will prevent the wearer from picking up the object between the wearer's thumb and second digit, thereby preventing the wearer from being able to pick up the object and put it in the wearer's mouth.

In some embodiments, the stiffening member 116 is formed integrally with the glove 100 and may be sewn into the lining of the glove 100. Suitable stiffening members 116 may be formed of plastic, metal, fabric, hardening polymers, or any suitable combination or other material. Furthermore, the stiffening member 116 may be rigid, or may have limited flexibility sufficient to inhibit the thumb and second digit from coming together. In some cases, the stiffening member 116 may comprise bulk, such as padding, that interferes with the thumb and second digit from contacting one another.

Figure 2:
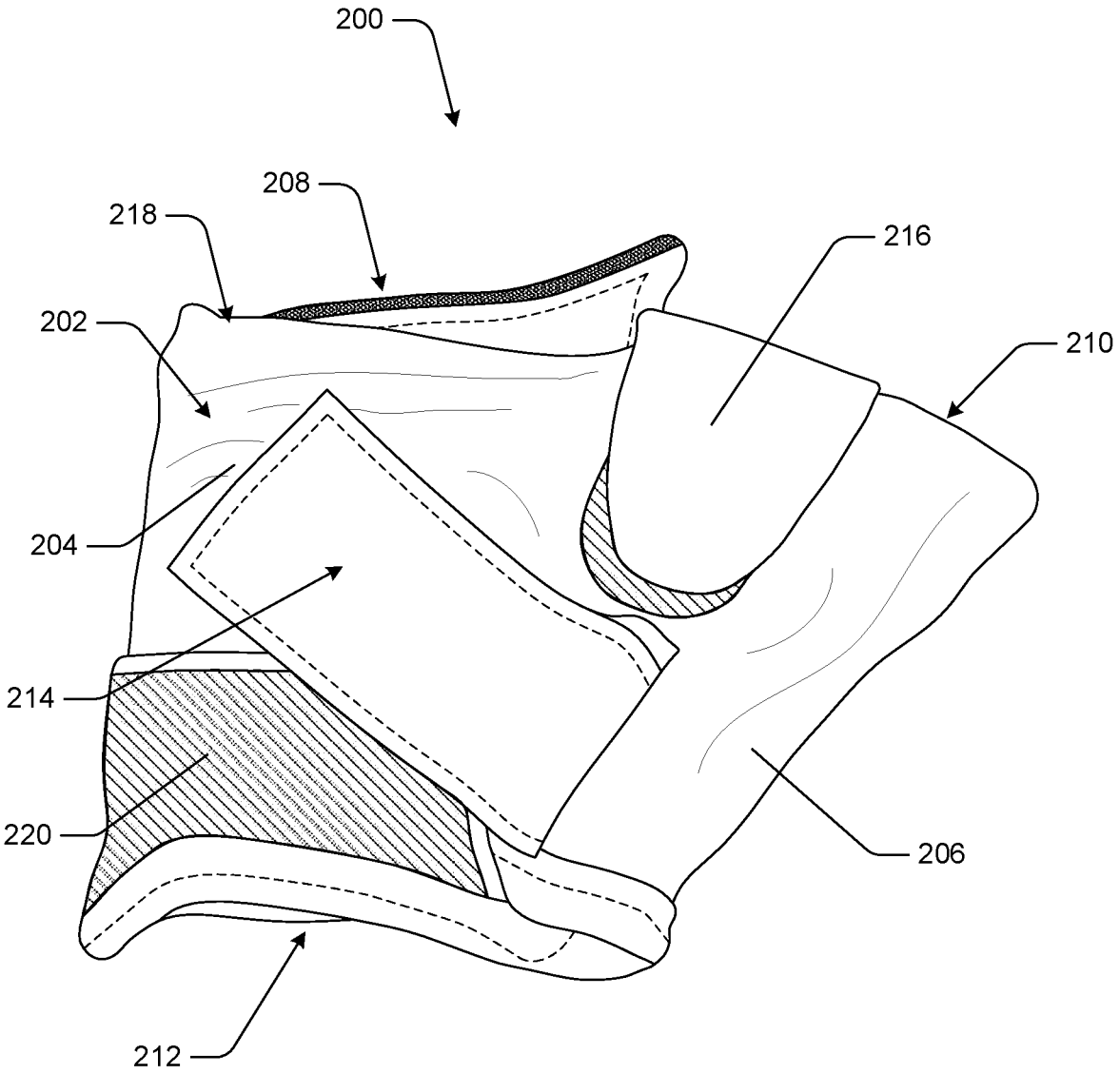
FIG. 2 shows a fingerless glove with an attachable stiffening member, in accordance with some embodiments.

With reference to FIG. 2, an embodiment of a crawling glove 200 is shown having a back portion 202 that includes a lateral portion 204 and a medial portion 206. A finger hole 208, a thumb hole 210, and a wrist portion 212 allow a hand to be inserted into the glove 200 with the four fingers extending through the finger hole 208 and the thumb extending through the thumb hole 210.

The wrist portion 212 may have an elastic material that closes the wrist portion around the wrist of wearer and may additionally or alternatively have a closure 214. As illustrated, a loop portion 220 may cooperate with a hook portion on the underside of the closure 214 to allow the medial portion 206 to be secured relative to the lateral portion 204. In this way, the glove 200 may be securely affixed to the hand of a wearer. In many cases, the closure 214 inhibits a wearer that is inexperienced in closure mechanisms from removing the glove 200. In some cases, a baby may try to remove the glove, such as by using their other hand, or their mouth, to pull on the glove. In some instances, the closure 214 is secure enough to prevent a wearer from removing the glove 200 simply by pulling on it without unfastening the closure 214.

As illustrated, a stiffening member 216 may be attached to the outside of the glove 200 between the thumb and the second digit. In some instances, the stiffening member 216 may be removably secured to the glove 200, such as by a cooperating hook and loop fastening mechanism, as is well-known. In other embodiments, the stiffening member 216 may be permanently affixed to the glove 200, such as by stitching, adhesives, mechanical bonding, and the like.

The stiffening member 216 may be formed of material having sufficient bulk or stiffness to inhibit movement of the thumb toward the second digit, and vice versa. That is, while wearing the glove 200, a wearer is inhibited from touching the end of their thumb to the end of their second digit, thus preventing a baby from picking up items between their thumb and pointer finger. The fingers may still able to move, that is, they may not be locked into a rigid position or orientation but are inhibited from allowing a baby to pick up an object.

The finger hole 208 may have a finger hole rim 218 that defines the finger hole 208 opening and may be padded and/or stiffened to inhibit certain movements, as will be described later in further detail.

Figure 3:
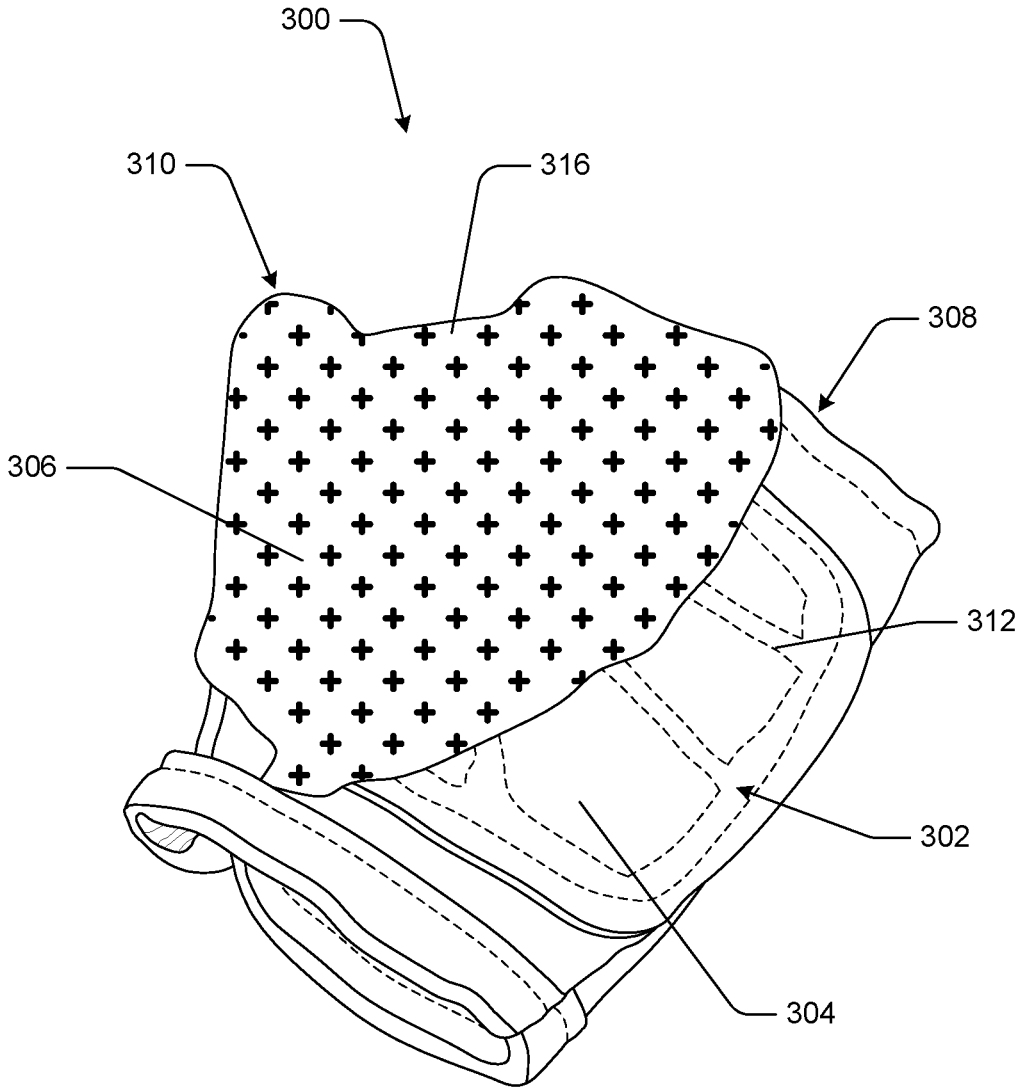
FIG. 3 shows a palm side of a fingerless glove, in accordance with some embodiments.

With reference to FIG. 3, a crawling glove 300 is illustrated showing a palm portion 302. The palm portion 302 may have a wear pad 304 and/or a non-slip pad 306. In typical use, a baby wearing the described glove 300 will largely be self-mobile through crawling. The wear pad 304 may provide abrasion resistance for the glove 300 and the wearer from the floor, objects, or other surfaces that may abrade the glove or the baby. In some instances, the wear pad may be formed of leather or other suitable textile material that provides some protection to the baby and to the glove 300.

The palm portion 302 may further include a non-slip pad 306, which allows the wearer to place the palm flat on the ground, such as when crawling, without the tendency to slip on the floor surface. The non-slip pad 306 may include any of a number of materials, such as, for example, rubber, polymer, leather, or other natural or synthetic materials.

The non-slip pad 306 may additionally be textured to improve the anti-slip performance of the glove 300. The texture may be any suitable surface deformation and may comprise bumps, grooves, lands and valleys, or other suitable configuration in any desirable pattern or shape.

The palm portion 302 may include padding in addition to the wear pad 304 and/or the non-slip pad 306. In some embodiments, padding is added underneath the wear pad 304, which may be foam, rubber, fibers, or some other type of suitable padding and may be secured such as by stitching 312 which may also secure the wear pad 304 to the glove 300. Additionally, or alternatively, padding may be added underneath the non-slip pad 306. The padding provides some impact resistance and softening for the baby as she crawls across a hard floor. For instance, where a baby crawls across a tile, wood, or cement floor, the padding protects the baby's hand as she crawls across the hard floor.

A stiffening member 316 may be integral to the glove 300, such as is illustrated. In some embodiments, the stiffening member 316 does not protrude beyond the surface of the non-slip pad. In other words, when a baby wearing the glove places her palm flat on a surface, the stiffening member 316 does not put pressure on the palm of the baby. Thus, a baby can develop normally in learning to crawl without any additional pressure or stress on the baby's hand from the glove 300.

In use, the stiffening member 316 inhibits the baby's thumb and second digit from cooperating to pick up objects the baby encounters while crawling around, and thus prevents the baby from putting foreign objects in her mouth that she finds while crawling around.

Figure 4:
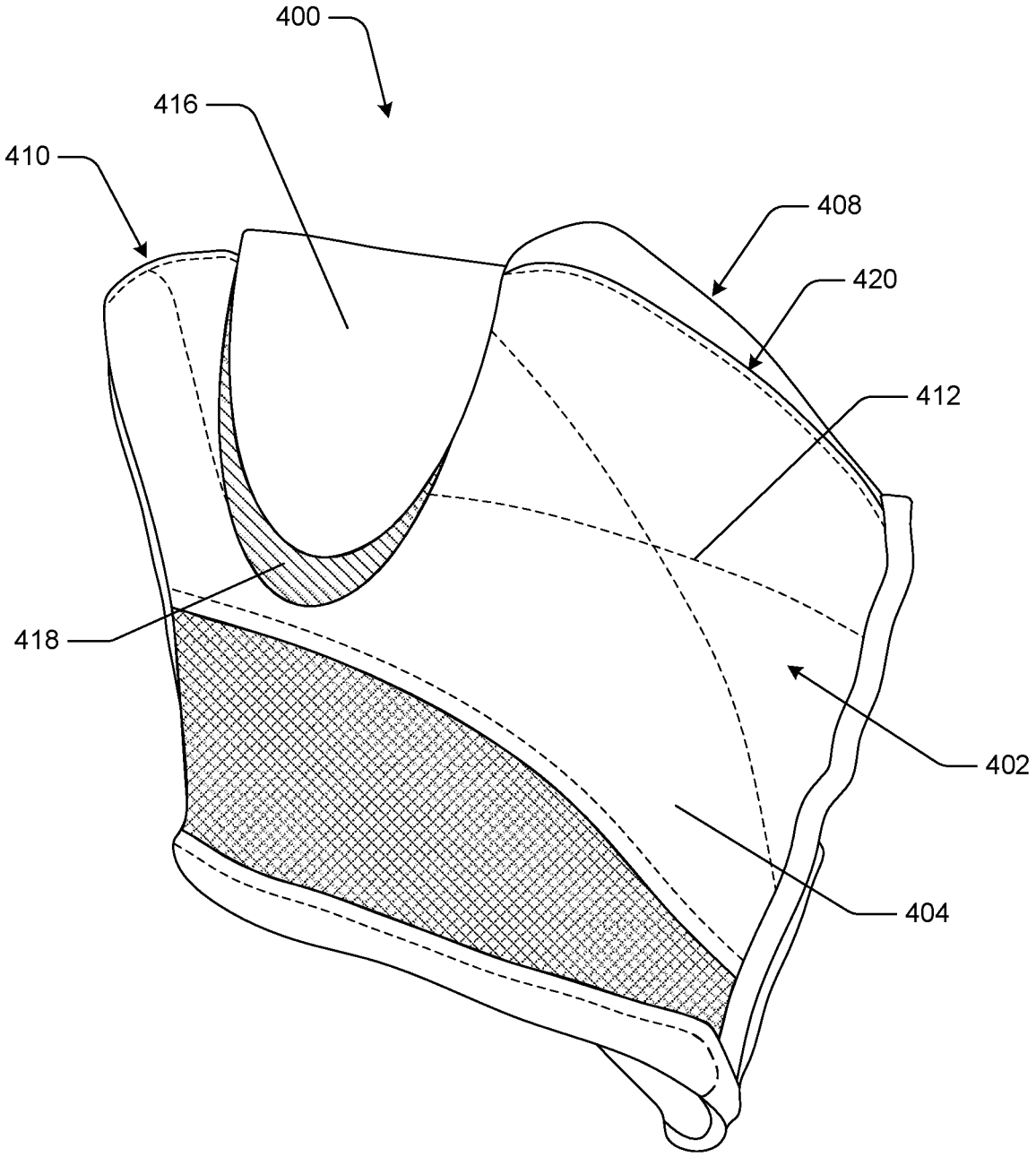
FIG. 4 shows a palm side of a fingerless glove, in accordance with some embodiments.

With reference to FIG. 4, a crawling glove 400 is illustrated showing a palm portion 402. The palm portion 402 may have a wear pad 404 which may dually function as a non-slip pad. The wear pad 404 may provide abrasion resistance for the glove 400 and the wearer from the floor, objects, or other surfaces that may abrade the glove or the baby. In some instances, the wear pad may be formed of leather or other suitable textile material that provides some protection to the baby and to the glove 400.

The palm portion 402 may include padding which may be added underneath the wear pad 304, and which may be any suitable material having a desired durometer hardness and may be secured such as by stitching 412 which may also secure the wear pad 404 to the glove 400.

A stiffening member 416 may be removably attached to the glove 400, such as by using hook and loop fastener material. In some embodiments, the loop portion 418 of the fastening system is affixed to the glove 400 in an area between the thumb and second digit and extending from the palm portion 402 to the back portion of the glove 400. The stiffening member 416 may carry the hook portion of the hook and loop fastening system and be selectively attached to the glove 400, such as when the wearer is on the floor and able to crawl. The stiffening member 416 may be removed from the glove 400 as desired, such as when the baby is placed in a high-chair and is allowed to use her fingers to eat, without having to remove the entire glove 400.

As described, the stiffening member inhibits the wearer from bringing the end of their thumb in close proximity to the end of their second digit. As a baby progresses in her fine motor skills, this is a common skill that a baby uses to pick up objects, especially small objects. At this stage of development, the baby has a further tendency to place small objects into her mouth. By inhibiting the thumb and second digit from coming into close proximity with one another, the wearer is unable to pick up small objects using these two fingers, which prevents her from putting potentially dangerous foreign objects into her mouth.

The stiffening member 416 may be made of any suitable material. In some instances, the stiffening member 416 is made of a natural or synthetic textile material, such as leather, cotton, nylon, or other suitable materials. In many cases, the stiffening member 416 extends substantially between the finger hole 408 and the thumb hole 410 and provides resistance to deformation of the glove 400 in that region.

A brace member 420 may be provided on the palm portion 402 adjacent the finger hole 408 to provide a measure of inflexibility to the glove 400 in this region. The brace member 420 may be rigid, semi rigid, or provide bulk to the glove 400 on the palm portion 402 adjacent the finger hole 408. In some instances, the brace member 420 inhibits or prevents a wearer from curling their four fingers to come into proximity of the palm portion 402.

For example, as a baby develops large and fine motor skills, a common way a baby picks up objects is by curling the four fingers toward the palm sufficiently to grasp items in the baby's fist. This leads to the situation where a baby can grip items in her fist and place them in her mouth. By providing a brace member 420 that inhibits a wearer from curling their four fingers in close proximity to the palm, the wearer is dissuaded from picking up objects in her fist and is thus unable to put them in her mouth.

In some embodiments, the brace member 420 is a strip of plastic formed integrally within the glove 400. The brace member 420 may also be formed of stiff textile material, such as leather, metal, polymer, or a combination of materials. In some instances, the brace member 420 allows some flexibility of the four fingers of the wearer, but not sufficient flexibility to allow her to bend her four fingers to contact her palm or come in close proximity to her palm, thereby inhibiting the baby from picking up object between her four fingers and palm.

Figure 5:
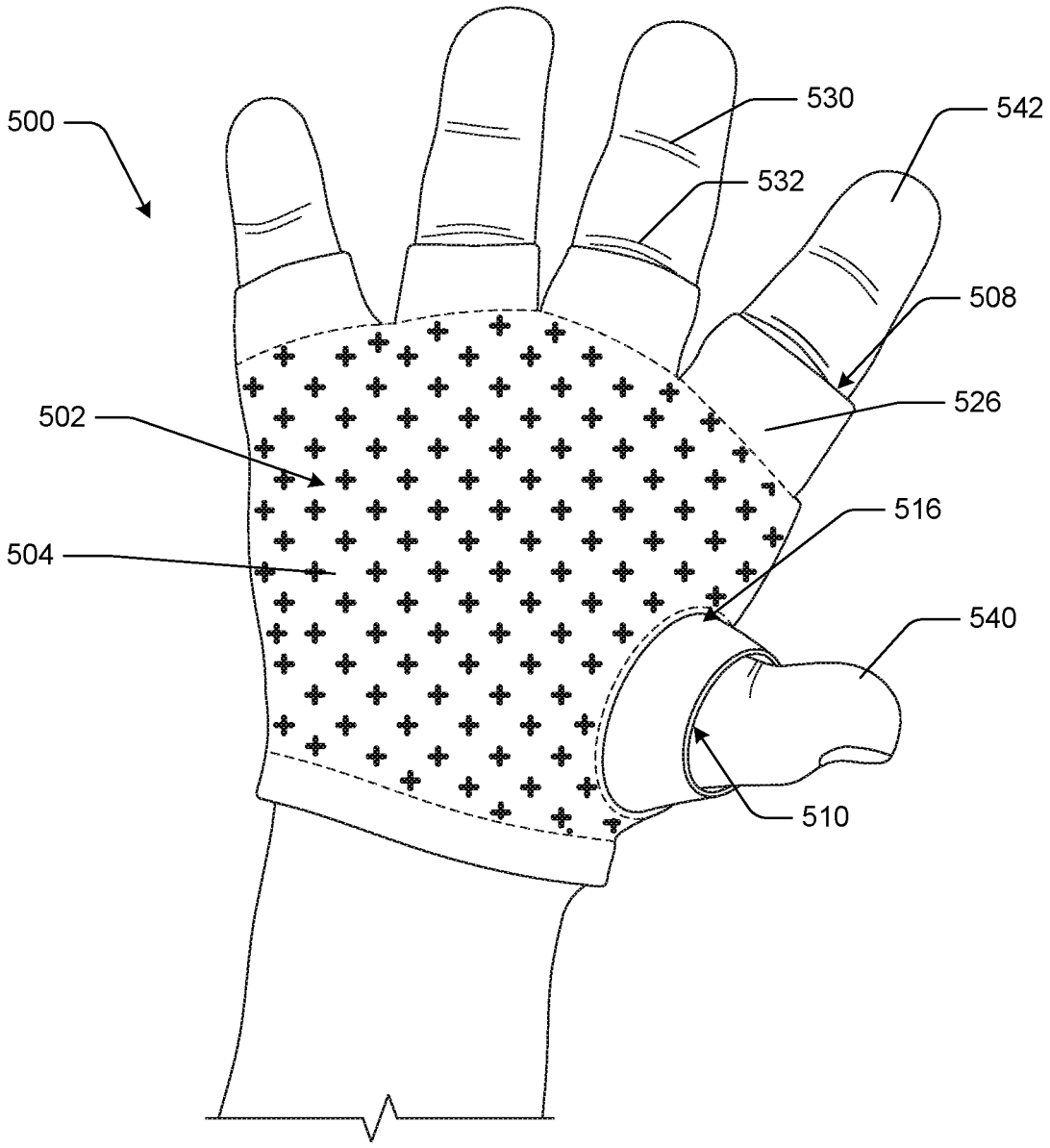
FIG. 5 shows a palm side of a fingerless glove being worn in accordance with some embodiments.

With reference to FIG. 5, a glove 500 is shown being worn. As illustrated, the glove 500 has a palm portion 502 having a wear pad 504 that may have non-slip characteristics. The glove 500 has one or more finger holes 508 through which fingers of a wearer may protrude. In some embodiments, the glove 500 may have individual finger holes 508 that extend a short distance along a wearer's fingers or may have a single finger hole through which the four fingers of the user may protrude. A thumb hole 510 allows the thumb of the wearer to protrude therethrough.

The fingers of the user have a distal interphalangeal digital crease 530, a middle interphalangeal digital crease 532, and a proximal interphalangeal digital crease (not shown). In many embodiments, including embodiments in which the glove 500 defines a single finger hole or individual finger holes, the glove 500 will extend to cover the proximal interphalangeal digital crease. A brace member 526 may be provided adjacent the finger hole 508 to inhibit flexion. Flexion is the biomechanical movement at the metacarpophalangeal joint (or knuckle joint) of the base of the fingers toward the palm. By inhibiting flexion at the metacarpophalangeal joint, a baby wearing the gloves is unable to pick up objects by bending her fingers toward her palm.

In some embodiments, the brace member 526 does not inhibit other finger movements, such as, for example, extension (moving the base of the fingers away from the palm), adduction (moving the fingers toward the middle finger), abduction (spreading the fingers away from the middle finger), flexion (moving the last two segments of the fingers toward the base of the fingers by bending the finger at the middle interphalangeal digital crease and at the distal interphalangeal digital crease), and extension (moving the last two segments of the finger away from the base of the fingers).

A stiffening member 516 is provided in an area between the thumb 540 and the second digit 542. The stiffening member 516 provides resistance to compression between the thumb 540 and second digit 542, and therefore inhibits a wearer from moving the thumb 540 and second digit 542 into close proximity to one another, such as is required to grasp grasping small objects between these two fingers.

More specifically, the biomechanics of the thumb allow it to perform several movements at its joints. At the carpometacarpal joint where the wrist bones (carpals) meet the metacarpals, the motion of the thumb includes abduction (moving the bone below the thumb towards the palm of the hand), extension (moving the bone below the thumb away from the hand), adduction (moving the bone below the thumb towards the back of the wrist), abduction (moving the bone below the thumb towards the front of the wrist), and opposition (moving the thumb across the palm of the hand to touch the other fingers). Additionally, the metacarpophalangeal joint at the base of the thumb allows further movements, including flexion (moving the joint at the base of the thumb towards the heel of the hand), extension (moving the joint at the base of the thumb away from the heel of the hand), adduction (movement of the thumb base towards the back of the hand), and abduction (movement of the thumb base away from the back of the hand).

In some embodiments, the stiffening member 516 is sized and located to inhibit abduction and opposition of the carpometacarpal joint of the thumb 540. The stiffening member 516 may also be sized and situated to inhibit flexion and abduction at the metacarpophalangeal joint of the thumb. Thus, in many embodiments, the stiffening member 516 inhibits a wearer from grasping objects between the thumb and any one or more of the other fingers. In this way, a wearer is able to place their palm flat on a surface, such as a floor for crawling, but is inhibited from picking up objects in their hand.

While the figures illustrate a single glove, it should be understood and appreciated that a pair of gloves may be provided and worn by a baby to inhibit the baby from picking up potentially dangerous object with either hand.

Figure 6:
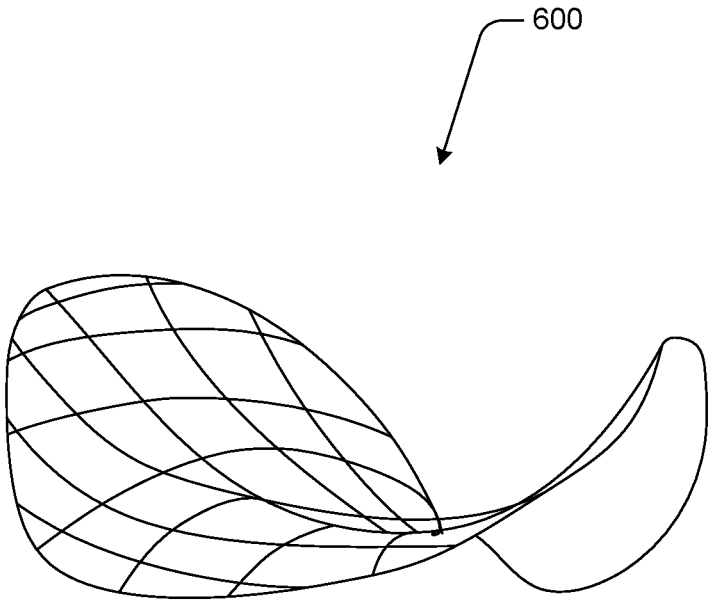
FIG. 6 illustrates one example of a stiffening member in accordance with some embodiments.

FIG. 6 illustrates an example of a stiffening member 600 that may be incorporated into a glove as described herein. In some embodiments, the stiffening member 600 is shaped as a hyperbolic paraboloid (e.g., having a saddle-shape). This shape provides smooth curved surfaces to support the area between the thumb and the second digit to inhibit relative movement therebetween as has been described. The stiffening member may be formed of any suitable material, such as, but not limited to, polymeric materials, textile materials, metals, or suitable combinations of materials.

In use, the gloves are put onto a babies' hands and the closure will secure the gloves so the baby can't pull them off, even by using her teeth. As the baby crawls, the palms of the gloves provide cushioning and abrasion resistance. The fingerless nature of the gloves allows the baby to have tactile experiences as she roams. The gloves, with the stiffener and/or brace, inhibit a baby from picking up any small object she may encounter as she crawls around. This allows a baby to roam around her environment while reducing the chances that the baby will pick up and eat something harmful, such as detergent pods, batteries, magnets, glass, pills, and other such harmful items. Similarly, the gloves inhibit a wearer from grasping and pulling objects, such as pulling an object off a table, shelf, or other place that could cause the object to fall onto a person below.

A person of ordinary skill in the art will recognize that any specific embodiment described herein can be modified in many ways. Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of" Finally, for ease of use, the terms "including" and "having" (and their derivatives), as used in the specification and claims, are interchangeable with and shall have the same meaning as the word "comprising.

As used herein, the term "or" is used inclusively to refer items in the alternative and in combination. As used herein, characters such as numerals refer to like elements. As used herein, the term "fingerless" as applied to a glove is used to mean that the fingers of a wearer are not completely enclosed within the glove, in other words, the term is used to mean that at least the fingertips extend beyond the glove and are outside the glove when the glove is being worn.

Embodiments of the present disclosure have been shown and described as set forth herein and are provided by way of example only. For instance, while many embodiments are described in the context of a crawling baby wearing the described gloves, embodiments of the gloves are equally applicable to older children, teenagers, and adults in order to inhibit people from grasping or pickup up objects that may be dangerous. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

What is claimed is:

1. A baby glove, comprising:

a body having a palm side and a back side and an open end for receiving a hand, the palm side configured to cover a palm of a wearer;

a unitary rigid brace member attached to the palm side, the unitary rigid brace member extending from the palm side distally to a location that is configured to cover a plurality of proximal interphalangeal digital creases and extending to be adjacent a plurality of middle interphalangeal digital creases of a wearer and prevent the wearer from flexing a metacarpophalangeal joint; and a stiffening member located and configured to inhibit thumb flexion and allow thumb extension of a wearer to inhibit the wearer from bringing a thumb fingertip into close proximity to a second digit fingertip.

2. The baby glove of claim 1, wherein the rigid brace member is further configured to inhibit a wearer from bringing the second digit fingertip into close proximity with the palm side.

3. The baby glove of claim 2 wherein the rigid brace member is configured to inhibit the wearer from brining a third digit fingertip, a fourth digit fingertip, and a fifth digit fingertip into close proximity with the palm side.

4. The baby glove of claim 2, wherein the rigid brace member is configured to inhibit flexion of a metacarpophalangeal joint of the wearer.

5. The baby glove of claim 1, wherein the stiffening member is configured to inhibit abduction and opposition of a carpometacarpal joint of the thumb of the wearer.

6. The baby glove of claim 1, further comprising a thumb hole configured to allow a thumb to extend therethrough and a finger opening configured to allow one or more fingers to extend therethrough, and wherein the stiffening member fixes a relative position of the thumb hole and the finger opening.

7. The baby glove of claim 6, wherein the finger opening is sized to allow four fingers of a wearer to extend through the finger opening to a location outside of the glove.

8. The baby glove of claim 1, wherein the stiffening member is removably attached to the baby glove.

9. The baby glove of claim 1, further comprising a fastening member for securing the baby glove to a wrist of a wearer.

10. The baby glove of claim 9, wherein the fastening member comprises a hook and loop fastener.

11. A glove, comprising:

a glove body;

a substantially rigid brace member coupled to a palm portion of the glove body, the palm portion configured to cover a palm of a wearer and wherein the substantially rigid brace member is sized and positioned to extend from the palm portion distally to a finger hole of the glove body, the substantially rigid brace member extending distally to a location adjacent a plurality of middle interphalangeal digital creases of a wearer that is configured to inhibit a the wearer from flexing a metacarpophalangeal joint; and a stiffening member configured to inhibit the wearer of the glove from touching a thumb to a pointer finger while allowing flexion of the thumb.

12. The glove of claim 11, wherein the substantially rigid brace member inhibits the wearer of the glove from touching the pointer finger, middle finger, ring finger, or little finger to a palm of the glove body.

13. The glove of claim 11, wherein the stiffening member is attached to the glove and extends between the finger hole and a thumb hole from the palm portion to a back portion of the glove body.

14. The glove of claim 11, wherein the stiffening member is removably attached to the glove body.

15. The glove of claim 14, further comprising a hook and loop fastener for securing the stiffening member to the glove body.

16. The glove of claim 11, further comprising a wear pad on the palm portion configured to provide abrasion resistance.

17. The glove of claim 11, wherein the palm portion comprises a non-skid surface.

18. The glove of claim 11, wherein the finger hole is sized to allow a second digit, a third digit, a fourth digit, and a fifth digit to extend therethrough.

19. The glove of claim 11, wherein the stiffening member is configured to inhibit abduction and opposition of a carpometacarpal joint of the thumb of the wearer.

20. The glove of claim 11, wherein the stiffening member fixes a relative position of a thumb hole and the finger hole.

* * * * *